US007351036B2

(12) United States Patent
Liang

(10) Patent No.: US 7,351,036 B2
(45) Date of Patent: Apr. 1, 2008

(54) TURBINE AIRFOIL COOLING SYSTEM WITH ELBOWED, DIFFUSION FILM COOLING HOLE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 178 days.

(21) Appl. No.: 11/293,462

(22) Filed: Dec. 2, 2005

(65) Prior Publication Data

US 2007/0128029 A1 Jun. 7, 2007

(51) Int. Cl.
*F01D 5/18* (2006.01)

(52) U.S. Cl. ..... 416/97 R

(58) Field of Classification Search ..... 416/97 R, 416/92; 415/115

See application file for complete search history.

(56) References Cited

U.S. PATENT DOCUMENTS 4,142,824 A * 3/1979 Andersen ..... 415/115
4,293,278 A 10/1981 Bachl
4,672,727 A * 6/1987 Field ..... 29/889.721
4,684,323 A 8/1987 Field
4,738,588 A 4/1988 Field
5,405,242 A 4/1995 Auxier et al.
5,577,889 A 11/1996 Terazaki et al.
5,624,231 A 4/1997 Ohtomo et al.
5,984,637 A 11/1999 Matsuo
6,126,397 A * 10/2000 Kvasnak et al. ..... 416/97 R
6,139,257 A 10/2000 Proctor et al.
6,176,676 B1 1/2001 Ikeda et al.
6,196,798 B1 3/2001 Fukuno et al.
6,264,428 B1 7/2001 Dailey et al.
6,383,602 B1 5/2002 Fric et al.
6,402,470 B1 * 6/2002 Kvasnak et al. ..... 416/97 R
6,464,461 B2 10/2002 Wilson et al.
6,887,033 B1 5/2005 Phillips et al.

* cited by examiner

*Primary Examiner*—Ninh H. Nguyen

(57) ABSTRACT

A cooling system for a turbine airfoil of a turbine engine having an elbowed film cooling hole positioned in an outer wall defining the turbine airfoil. The elbowed film cooling hole may include a first section extending from an inner surface of the outer wall into the outer wall, an elbow coupled to the first section in the outer wall, a second section attached to the elbow in the outer wall, and a diffusion slot attached to the second section, having an increasing width moving away from the second section, and extending to an opening in an outer surface of the outer wall. The cross-sectional areas of the first section, the elbow and the second section may be substantially equal to meter the flow of cooling fluids through the cooling system to efficiently add to the film cooling layer.

20 Claims, 3 Drawing Sheets

TURBINE AIRFOIL COOLING SYSTEM WITH ELBOWED, DIFFUSION FILM COOLING HOLE

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

In one conventional cooling system, diffusion slots have been used in outer walls of turbine airfoils. Typically, the diffusion slots are aligned with a metering slot that extends through the outer wall at an acute angle relative to the longitudinal axis of the diffusion slot. Thus, a need exists for a cooling system capable of providing sufficient cooling to composite airfoils.

SUMMARY OF THE INVENTION

This invention relates to a cooling system for turbine airfoils used in turbine engines. In particular, the turbine airfoil cooling system may include an internal cavity positioned between outer walls of the turbine airfoil and may include an elbowed film cooling hole in the outer wall. The elbowed film cooling hole may be positioned at a shallower angle than conventional designs. The elbowed film cooling hole may be adapted to receive cooling fluids from the internal cavity, meter the flow of cooling fluids through the elbowed film cooling hole, and release the cooling fluids into the film cooling layer proximate to an outer surface of the airfoil.

The turbine airfoil may be formed from a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil. An outer wall may form the generally elongated airfoil and may have at least one elbowed film cooling hole positioned in the outer wall. The elbowed film cooling hole may provide a cooling fluid pathway between the at least one cavity forming the cooling system and areas outside of the airfoil. The at least one elbowed film cooling hole may include a first section extending from an inner surface of the outer wall into the outer wall and an elbow coupled to the first section in the outer wall. The elbow of the at least one elbowed film cooling hole may change the direction of flow of cooling fluids in the at least one elbowed film cooling hole between about 45 degrees and about 75 degrees, and more particularly, about 60 degrees, relative to the direction of initial flow of the cooling fluids in the elbowed film cooling hole. The at least one elbowed film cooling hole may also include a second section attached to the elbow in the outer wall at an end of the elbow that is generally opposite to an end to which the first section is attached and a diffusion slot attached to the second section. The diffusion slot may have an increasing width moving away from the second section and may extend into an opening in an outer surface of the outer wall, wherein cross-sectional areas of the first section, the elbow and the second section may be substantially equal.

The diffusion slot may be configured to exhaust cooling fluids into the film cooling layer proximate to an outer surface of the airfoil without disrupting turbulence to the film cooling layer. A downstream surface of the diffusion slot may be positioned between about five degrees and about fifteen degrees from a longitudinal axis of the diffusion slot, and more particularly, about ten degrees from the longitudinal axis of the diffusion slot. An OD side surface of the diffusion slot may be positioned between about five degrees and about fifteen degrees from a longitudinal axis of the diffusion slot, and more particularly, about ten degrees from the longitudinal axis of the diffusion slot. An ID side surface of the diffusion slot may be positioned between about five degrees and about fifteen degrees from a longitudinal axis of the diffusion slot, and more particularly, about ten degrees from the longitudinal axis of the diffusion slot. The second section and the diffusion slot may be aligned along an axis that is positioned at an angle to the outer surface of the airfoil between about 15 degrees and about 45 degrees, and more particularly, at an angle to the outer surface of the airfoil of about 25 degrees.

The at least one elbowed film cooling hole may include a plurality of elbowed film cooling holes positioned in the outer wall of the airfoil. The plurality of elbowed film cooling holes may be positioned in spanwise rows. The elbowed film cooling holes of adjacent spanwise rows may be offset chordwise.

During use, cooling fluids flow into the cooling system in a turbine airfoil and into a central cavity. The cooling fluids flow from the cavity into the first section of the elbowed film cooling hole, through the elbow, and into the second section. The cooling fluids then flow into the diffusion slot. The elbow may reduce the velocity of the cooling fluids flowing through the elbowed film cooling hole. In addition, the first and second sections and the elbow meter the flow of the cooling fluids. The cooling fluids flowing in the diffusion slot lose velocity. The loss of velocity of the cooling fluids enables the cooling fluids to be expelled from the airfoil through the opening in the outer wall while causing limited turbulence in the film cooling layer. The cooling fluids become part of the film cooling layer proximate to the outer surface of the generally elongated airfoil.

An advantage of this invention is that the inclusion of the elbow in the film cooling hole enables the hole to be positioned at a shallower angle relative to the outer surface of the airfoil, thereby minimizing formation of vortices in the film cooling layer upon discharging cooling fluids from the film cooling hole. Such a position also maximizes the film cooling hole cross-sectional area at the opening in the outer surface.

Another advantage of this invention is that the first section, second section, and elbow of the elbowed film cooling hole meter the flow of cooling fluid through the hole. In addition, a smooth transition may exist between the second section and the diffusion slot. The velocity and flow rate of the cooling fluids flowing through the hole may be controlled to maximize cooling of the outer wall and to prevent the film cooling layer from being unnecessarily disturbed.

Another advantage of this invention is that the position of attachment between the second section and the diffusion slot does not create undesirable vorticies in the elbowed film cooling hole.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
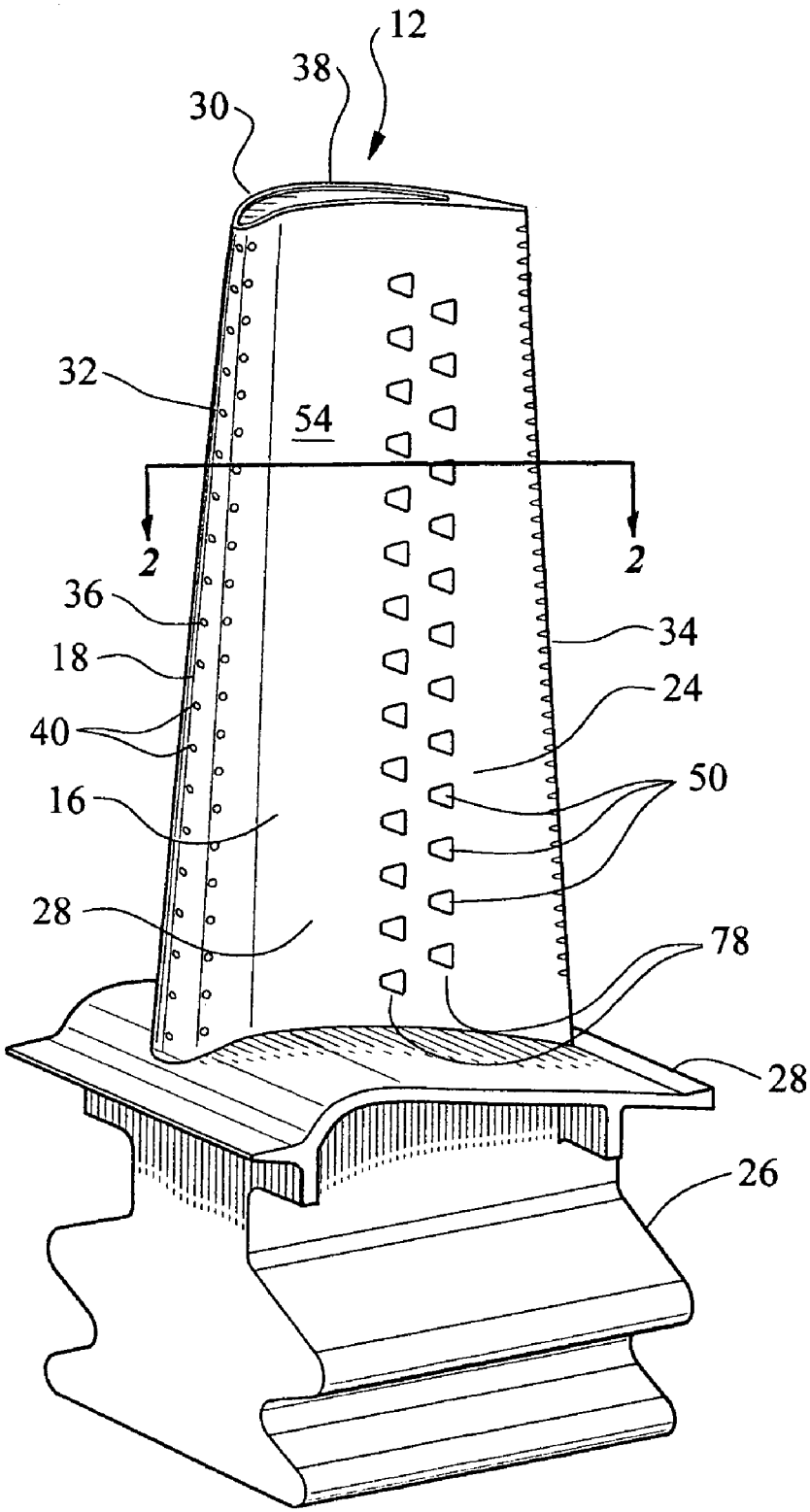
FIG. 1 is a perspective view of a turbine airfoil having features according to the instant invention.
Figure 2:
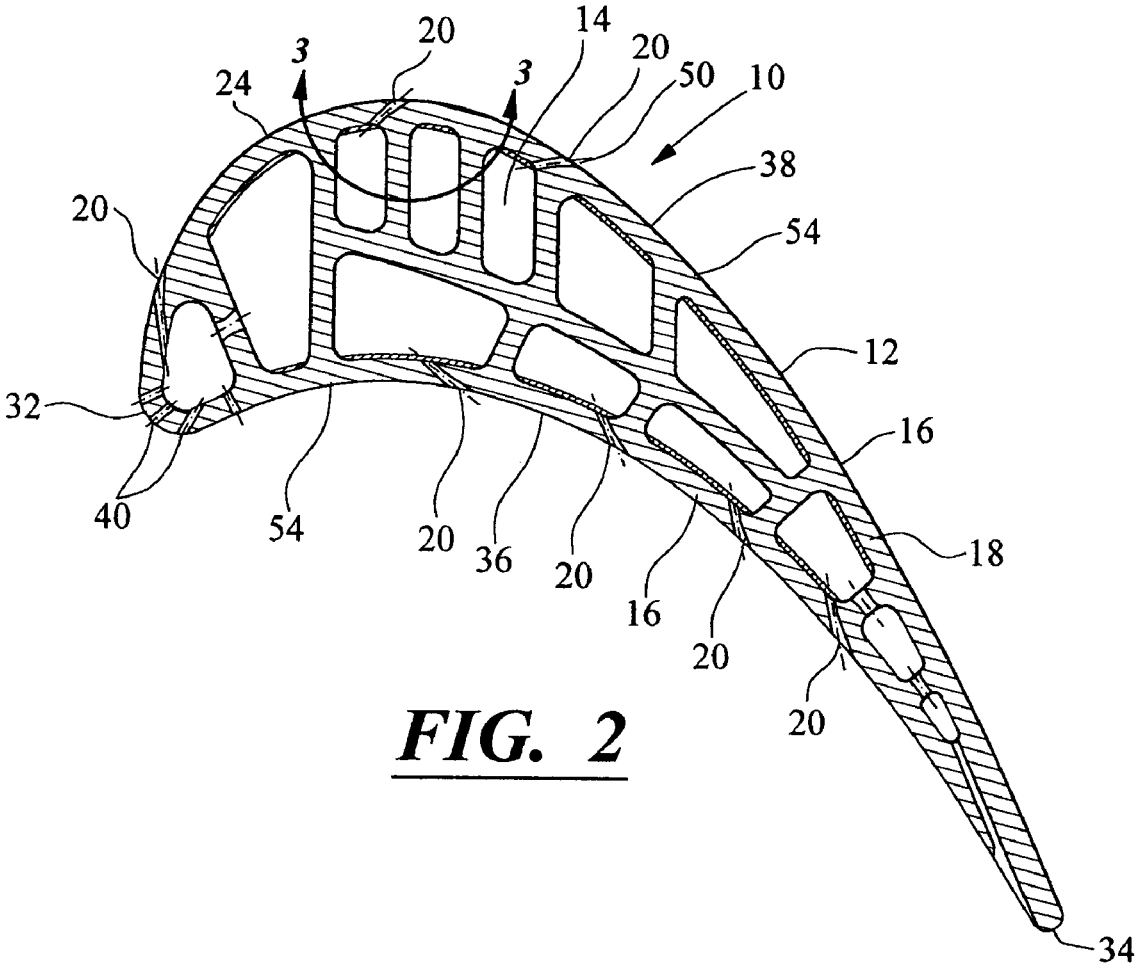
FIG. 2 is cross-sectional view, referred to as a filleted view, of the turbine airfoil shown in FIG. 1 taken along line 2-2.

As shown in FIGS. 1-5, this invention is directed to a turbine airfoil cooling system 10 for a turbine airfoil 12 used in turbine engines. In particular, the turbine airfoil cooling system 10 is directed to a cooling system 10 having an internal cavity 14, as shown in FIG. 2, positioned between outer walls 16 forming a housing 18 of the turbine airfoil 12. The cooling system 10 may include an elbowed film cooling hole 20 in the outer wall 16 that may be adapted to receive cooling fluids from the internal cavity 14, meter the flow of cooling fluids through the elbowed film cooling hole 20, and release the cooling fluids into the film cooling layer proximate to an outer surface 54 of the airfoil 12. The elbowed film cooling hole 20 may be positioned at a shallower angle than film cooling holes without elbows.

The turbine airfoil 12 may be formed from a generally elongated airfoil 24 coupled to a root 26 at a platform 28. The turbine airfoil 12 may be formed from conventional metals or other acceptable materials. The generally elongated airfoil 24 may extend from the root 26 to a tip section 30 and include a leading edge 32 and trailing edge 34. Airfoil 24 may have an outer wall 16 adapted for use, for example, in a first stage of an axial flow turbine engine. Outer wall 16 may form a generally concave shaped portion forming pressure side 36 and may form a generally convex shaped portion forming suction side 38. The cavity 14, as shown in FIG. 2, may be positioned in inner aspects of the airfoil 24 for directing one or more gases, which may include air received from a compressor (not shown), through the airfoil 24 and out one or more orifices 40, such as in the leading edge 32, in the airfoil 24 to reduce the temperature of the airfoil 24 and provide film cooling to the outer wall 16. As shown in FIG. 1, the orifices 40 may be positioned in a leading edge 32, a tip section 30, or outer wall 16, or any combination thereof, and have various configurations. The cavity 14 may be arranged in various configurations and is not limited to a particular flow path.

Figure 3:
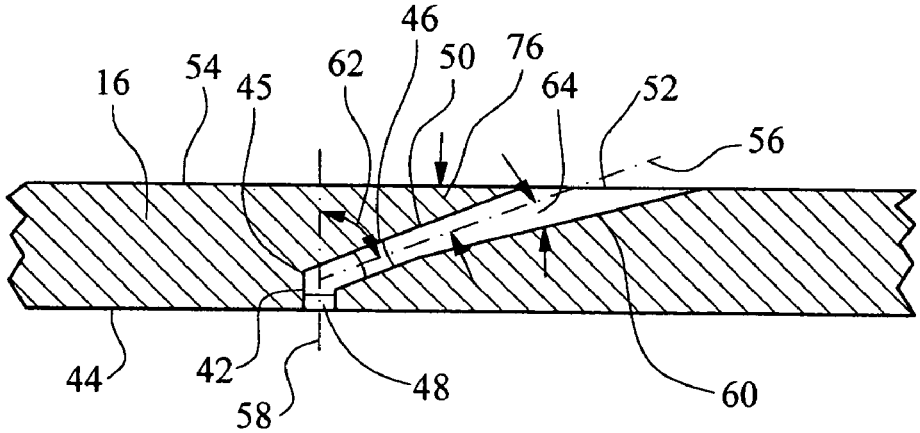
FIG. 3 is a detailed view of an elbowed film cooling hole shown in FIG. 2.
Figure 4:
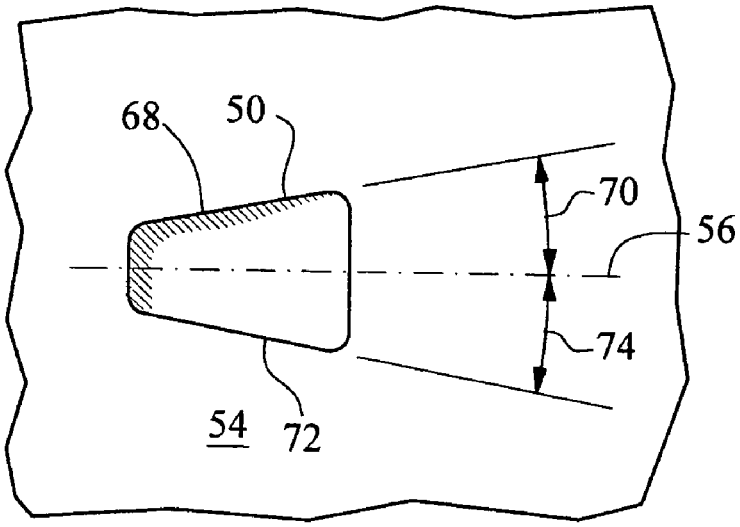
FIG. 4 is a partial side view of an outer surface of the turbine airfoil showing an elbowed film cooling hole.

The cooling system 10, as shown in FIGS. 2-4, may include one or more elbowed film cooling holes 20 in the outer wall 16. The elbowed film cooling hole 20 may be formed from a first section 42 extending from an inner surface 44 of the outer wall 16. The first section 42 may be positioned generally perpendicular to the inner surface 44 or may have other appropriate configurations. The elbowed cooling hole 20 may also include an elbow 45 attached to the first section 42, and a second section 46 extending from the elbow 45. The elbowed film cooling hole 20 may change the direction of cooling fluid flow between about 45 degrees and about 75 degrees, and more particularly, about 60 degrees, as shown at angle 62 in FIG. 3. The first section 42, the elbow 45, and the second section 46 may meter the flow of cooling fluids through the elbowed film cooling hole 20. The cooling fluid flow may be metered through the size of the openings in the first section 42, the elbow 45, and the second section 46. In at least one embodiment, the cross-sectional areas of the openings 48 of the first section 42, the elbow 45, and the second section 46 may be substantially equal. Thus, the flow of cooling fluids in this embodiment may be metered through the first section 42, the elbow 45, and the second section 46.

The elbowed film cooling hole 20 may include a diffusion slot 50 extending from the second section 46 to an opening 52 in an outer surface 54 of the outer wall 16. The cross-sectional area of the diffusion slot 50 may increase moving from the second section 46 toward the opening 52 in the outer wall 16. The diffusion slot 50 may have a smooth transition with the second section 46 such that no areas exist for the formation of eddies. In at least one embodiment, the diffusion slot 50 may be aligned with the second section 46 along a longitudinal axis 56. The longitudinal axis 56 may be positioned between about 45 degrees and about 75 degrees relative to a longitudinal axis 58 of the first section 42. Thus, in at least one embodiment, the elbow 45 may change the flow of cooling fluids between about 45 degrees and about 75 degrees, and more particularly, about 60 degrees. A downstream surface 60 of the diffusion slot 50 may be positioned at an angle 64 of between about five degree and about fifteen degrees relative to the longitudinal axis 56, and more particularly, about ten degrees relative to the longitudinal axis 56. As shown in FIG. 4, an OD wall 68 may be positioned at an angle 70 of between about five degree and about fifteen degrees relative to the longitudinal axis 56, and more particularly, about ten degrees relative to the longitudinal axis 56. In addition, an ID wall 72 may be positioned at an angle 74 of between about five degree and about fifteen degrees relative to the longitudinal axis 56, and more particularly, about ten degrees relative to the longitudinal axis 56.

Referring again to FIG. 3, the diffusion slot 50 may be positioned at an angle 76 relative to the outer surface 54 of the outer wall 16 to facilitate efficient discharge of cooling fluids into the film cooling layer proximate to the outer surface 54 without creating undesirable turbulence in the film cooling layer. The angle 76 of the longitudinal axis 56 of the diffusion slot 50 relative to the outer surface 54 is between about 15 degrees and about 45 degrees, and more particularly, about 25 degrees.

The generally elongated airfoil 24 may include a plurality of elbowed film cooling holes 20 positioned in the outer wall 16 of the generally elongated airfoil 24. In at least one embodiment, as shown in FIG. 1, the plurality of elbowed film cooling holes 20 may be aligned into spanwise rows 78. The individual elbowed film cooling holes 20 in adjacent spanwise rows 78 may or may not be offset chordwise.

During use, cooling fluids flow into the cavity 14 and into the first section 42 of the elbowed film cooling hole 20. The first and second sections 42, 46 and the elbow 45 may meter the flow of cooling fluids through the elbowed film cooling hole 20. In at least one embodiment, the first and second sections 42, 46 and the elbow 45 are substantially cylindrical and have substantially equal diameters. The elbow 45 reduces the velocity of the cooling fluids flowing through the elbowed film cooling hole 20. The cooling fluids flow through the first and second sections 42, 46 and the elbow 45 and flow into the diffusion slot 50, where the cooling fluids lose velocity. The loss of velocity of the cooling fluids enables the cooling fluids to be expelled from the airfoil 24 through the opening 48 in the outer wall 16 while causing limited turbulence in the film cooling layer. The cooling fluids become part of the film cooling layer proximate to the outer surface 54 of the generally elongated airfoil 24.

Figure 5:
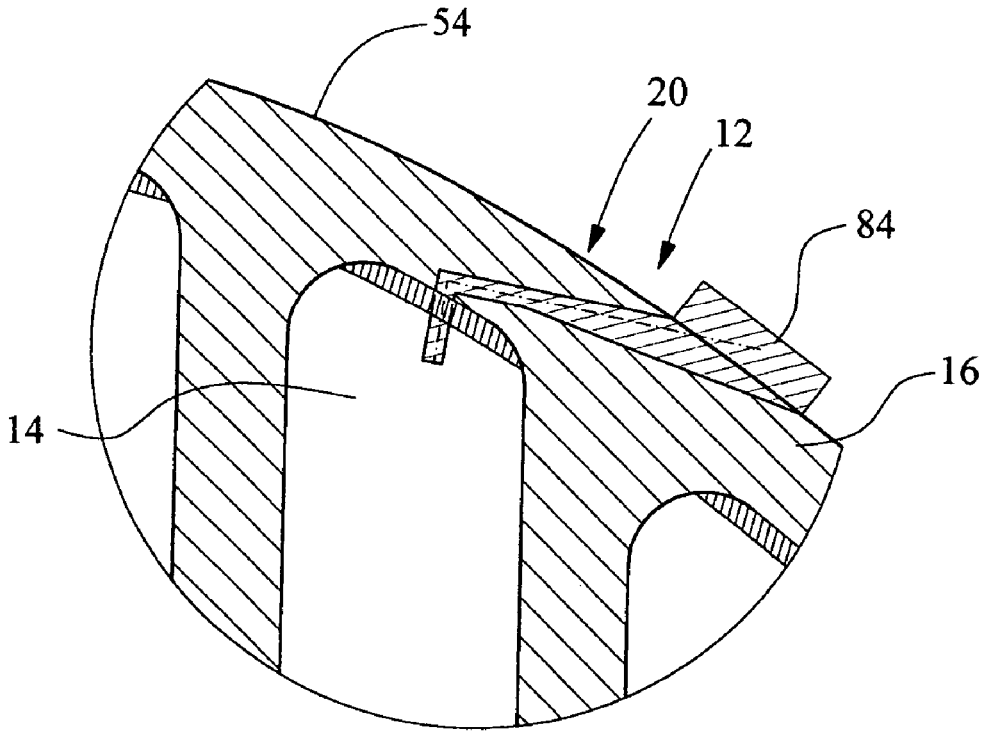
FIG. 5 is a detailed view of an elbowed film cooling hole shown in FIG. 1 with a ceramic core installed during the manufacturing process.

The elbowed film cooling hole 20 may be formed using a composite core casting technique, as shown in FIG. 5. The technique includes inserting a film cooling hole core 84 into the airfoil wax die during the conventional casting process. The composite core 84 may be removed after formation of the airfoil and cooling elbowed film cooling hole.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil;

an outer wall forming the generally elongated airfoil and having at least one elbowed film cooling hole positioned in the outer wall and providing a cooling fluid pathway between the at least one cavity forming the cooling system and outside of the airfoil;

wherein the at least one elbowed film cooling hole includes a first section extending from an inner surface of the outer wall into the outer wall, an elbow coupled to the first section in the outer wall, a second section attached to the elbow in the outer wall at an end of the elbow that is generally opposite to an end to which the first section is attached, and a diffusion slot attached to the second section, having an increasing width moving away from the second section, and extending to an opening in an outer surface of the outer wall, wherein cross-sectional areas of the first section, the elbow and the second section are substantially equal;

wherein the second section and the diffusion slot are aligned along an axis that is positioned at an angle to the outer surface of the airfoil between about 15 degrees and about 45 degrees.

2. The turbine airfoil of claim 1, wherein the elbow of the at least one elbowed film cooling hole changes the direction of flow of cooling fluids in the at least one elbowed film cooling hole between about 45 degrees and about 75 degrees.

3. The turbine airfoil of claim 2, wherein a downstream surface of the diffusion slot is positioned between about five degrees and about fifteen degrees from a longitudinal axis of the diffusion slot.

4. The turbine airfoil of claim 1, wherein an OD side surface of the diffusion slot is positioned between about five degrees and about fifteen degrees from a longitudinal axis of the diffusion slot.

5. The turbine airfoil of claim 1, wherein an ID side surface of the diffusion slot is positioned between about five degrees and about fifteen degrees from a longitudinal axis of the diffusion slot.

6. The turbine airfoil of claim 1, wherein the axis is positioned at an angle to the outer surface of the airfoil of about 25 degrees.

7. The turbine airfoil of claim 1, wherein the at least one elbowed film cooling hole comprises a plurality of elbowed film cooling holes positioned in the outer wall of the airfoil.

8. The turbine airfoil of claim 1, wherein the at least one elbowed film cooling hole comprises a plurality of elbowed film cooling holes positioned in the outer wall of the airfoil and positioned in spanwise rows, wherein the elbowed film cooling holes of adjacent spanwise rows are offset chordwise.

9. A turbine airfoil, comprising:

a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil;

an outer wall forming the generally elongated airfoil and having at least one elbowed film cooling hole positioned in the outer wall and providing a cooling fluid pathway between the at least one cavity forming the cooling system and outside of the airfoil;

wherein the at least one elbowed film cooling hole includes a first section extending from an inner surface of the outer wall into the outer wall, an elbow coupled to the first section in the outer wall, a second section attached to the elbow in the outer wall at an end of the elbow that is generally opposite to an end to which the first section is attached, and a diffusion slot attached to the second section, having an increasing width moving away from the second section. and extending to an opening in an outer surface of the outer wall, wherein cross-sectional areas of the first section, the elbow and the second section are substantially equal;

wherein the at least one elbowed film cooling hole comprises a plurality of elbowed film cooling holes positioned in the outer wall of the airfoil; and wherein the plurality of elbowed film cooling holes are positioned in spanwise rows.

10. The turbine airfoil of claim 9, wherein elbowed film cooling holes of adjacent spanwise rows are offset chordwise.

11. The turbine airfoil of claim 9, wherein the second section and the diffusion slot are aligned along an axis that is positioned at an angle to the outer surface of the airfoil between about 15 degrees and about 45 degrees.

12. The turbine airfoil of claim 9, wherein the elbow of the at least one elbowed film cooling hole changes the direction of flow of cooling fluids in the at least one elbowed film cooling hole between about 45 degrees and about 75 degrees.

13. The turbine airfoil of claim 9, wherein a downstream surface of the diffusion slot is positioned between about five degrees and about fifteen degrees from a longitudinal axis of the diffusion slot.

14. The turbine airfoil of claim 9, wherein an OD side surface of the diffusion slot is positioned between about five degrees and about fifteen degrees from a longitudinal axis of the diffusion slot.

15. The turbine airfoil of claim 9, wherein an ID side surface of the diffusion slot is positioned between about five degrees and about fifteen degrees from a longitudinal axis of the diffusion slot.

16. A turbine airfoil, comprising:

a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil;

an outer wall forming the generally elongated airfoil and having at least one elbowed film cooling hole positioned in the outer wall and providing a cooling fluid pathway between the at least one cavity forming the cooling system and outside of the airfoil;

wherein the at least one elbowed film cooling hole includes a first section extending from an inner surface of the outer wall into the outer wall, an elbow coupled to the first section in the outer wall, a second section attached to the elbow in the outer wall at an end of the elbow that is generally opposite to an end to which the first section is attached, and a diffusion slot attached to the second section, having an increasing width moving away from the second section, and extending to an opening in an outer surface of the outer wall, wherein diameters of the first section, the elbow and the second section are substantially equal and wherein the elbow of the at least one elbowed film cooling hole changes the direction of flow of cooling fluids in the at least one elbowed film cooling hole between about 45 degrees and about 75 degrees; and wherein the at least one elbowed film cooling hole comprises a plurality of elbowed film cooling holes positioned in the outer wall of the airfoil in spanwise rows, wherein elbowed film cooling holes of adjacent spanwise rows are offset chordwise.

17. The turbine airfoil of claim 16, wherein the elbow of the at least one elbowed film cooling hole changes the direction of flow of cooling fluids in the at least one elbowed film cooling hole about 60 degrees.

18. The turbine airfoil of claim 16, wherein the downstream surface of the diffusion slot is positioned about ten degrees from the longitudinal axis of the diffusion slot.

19. The turbine airfoil of claim 16, wherein the OD side surface of the diffusion slot is positioned about ten degrees from a longitudinal axis of the diffusion slot, and the ID side surface of the diffusion slot is positioned about ten degrees from the longitudinal axis of the diffusion slot.

20. The turbine airfoil of claim 16, wherein an axis extending through the diffusion slot is positioned at an angle to the outer surface of the airfoil of about 25 degrees.

* * * * *